US010895833B2

(12) United States Patent
Yang et al.

(10) Patent No.: US 10,895,833 B2
(45) Date of Patent: Jan. 19, 2021

(54) SLIDING SHEET AND METHOD FOR MANUFACTURING THE SAME

(71) Applicant: SHENZHEN FANCY CREATION INDUSTRIAL LIMITED, Shenzhen (CN)

(72) Inventors: Mingfu Yang, Shenzhen (CN); Gang Jin, Shenzhen (CN)

(73) Assignee: SHENZHEN FANCY CREATION INDUSTRIAL LIMITED, Shenzhen (CN)

( * ) Notice: Subject to any disclaimer, the term of this patent is extended or adjusted under 35 U.S.C. 154(b) by 372 days.

(21) Appl. No.: 15/871,143

(22) Filed: Jan. 15, 2018

(65) Prior Publication Data

US 2019/0163102 A1 May 30, 2019

Related U.S. Application Data

(63) Continuation of application No. PCT/CN2017/011364, filed on Nov. 29, 2017.

(51) Int. Cl.

| | |
|---|---|
| ***D04H 3/04*** | (2012.01) |
| ***D06H 7/00*** | (2006.01) |
| ***D03D 1/00*** | (2006.01) |
| ***D03D 11/00*** | (2006.01) |
| ***G03G 15/20*** | (2006.01) |
| ***D03D 3/08*** | (2006.01) |

(52) U.S. Cl.

CPC ..... *G03G 15/2053* (2013.01); *D03D 1/00* (2013.01); *D03D 3/08* (2013.01); *D03D 11/00* (2013.01); *D06H 7/00* (2013.01); *G03G 15/2025* (2013.01); *D10B 2403/02* (2013.01); *D10B 2505/00* (2013.01)

(58) Field of Classification Search

None

See application file for complete search history.

(56) References Cited

U.S. PATENT DOCUMENTS

| | | | | |
|---|---|---|---|---|
| 5,303,008 | A | 4/1994 | Kalyandurg et al. | |
| 2004/0198119 | A1* | 10/2004 | Narumi | D03D 3/08 442/203 |
| 2007/0079886 | A1* | 4/2007 | Ge | D02H 13/16 139/11 |

FOREIGN PATENT DOCUMENTS

| | | | |
|---|---|---|---|
| CN | 103941565 | A | 7/2014 |
| CN | 104007644 | A | 8/2014 |
| CN | 205691942 | U | 11/2016 |

(Continued)

*Primary Examiner* — Shawn Mckinnon

(74) *Attorney, Agent, or Firm* — Kilpatrick Townsend & Stockton, LLP

(57) ABSTRACT

A sliding sheet includes a fabric layer is disclosed. The fabric layer includes warp yarns and weft yarns. The warp yarns are interlaced with the weft yarns. The sliding sheet has a first edge extending in a length direction of the sliding sheet. The warp yarns are bent toward a middle portion of the first edge. A method for manufacturing the sliding sheet is also disclosed. An auxiliary yarn is woven with the warp yarns and the weft yarns to form a fabric raw layer. A tension for weaving the auxiliary yarn is adjusted so that the tension of the auxiliary yarn is greater than the tension of the warp yarns, thereby bending the warp yarns in the fabric raw layer toward the auxiliary yarn. The fabric raw layer is heated to fix the shape of yarns, and cut into the fabric layer to form the sliding sheet.

11 Claims, 6 Drawing Sheets

(56) References Cited

FOREIGN PATENT DOCUMENTS

| | | | |
|---|---|---|---|
| JP | 2002357960 | A | 12/2002 |
| JP | 5395514 | B2 | 1/2014 |
| JP | 2015030959 | A | 2/2015 |
| JP | 2017005662 | A | 1/2017 |

* cited by examiner

SLIDING SHEET AND METHOD FOR MANUFACTURING THE SAME

CROSS-REFERENCE TO RELATED APPLICATION

This application is a continuation in part under 35 U.S.C. § 120 of international patent application PCT/CN2017/113643 filed on Nov. 29, 2017, the content of which is also hereby incorporated by reference.

FIELD

The present application relates to fixing technology, and more particularly to sliding sheets and methods for manufacturing the same.

BACKGROUND

In image forming apparatuses such as copying machines, printers and facsimiles, toner particles are directly adsorbed on a surface of a recording medium, such as a paper, under an electric field or adsorbed on a surface of a photoreceptor drum before being transferred onto the surface of the recording medium to form an unfixed image. The recording medium carrying the unfixed image passes a fixing device including a pressure roller as a driving roller and a heating roller as a driven roller, while the toner particles are heated, pressed, and then melted, thereby being fixed to the surface of the recording medium. An advanced heating roller includes an endless fixing belt, a heat source and a supporting member disposed inside a loop formed by the endless fixing belt, and a sliding sheet disposed between the supporting member and the endless fixing belt. The supporting member is configured for supporting the sliding sheet. The endless fixing belt is rotated with the pressure roller and moved relative to the supporting member and the sliding sheet which are stationary. A lubricant is provided on the surface of the sliding sheet to reduce a friction between the sliding sheet and the endless fixing belt, thereby alleviating a frictional loss caused by a long-term use of the endless fixing belt and preventing the endless fixing belt from breaking.

The lubricant is applied on the sliding sheet before the sliding sheet is installed with the endless fixing belt, and no additional lubricant is added during a service life of the sliding sheet. During relative moving between the sliding sheet and the endless fixing belt, the lubricant on the sliding sheet is taken away from the sliding sheet by the endless fixing belt through a surface contact between the sliding sheet and the endless fixing belt. After a round of the rotation of the endless fixing belt, the lubricant is recovered by the sliding sheet. As the lubricant cannot be replenished after assembling of the image forming apparatus, retaining the original amount of the lubricant is important and affects the service life of the fixing device.

SUMMARY

What is needed, therefore, is to provide a sliding sheet capable of preventing or reducing leakage of a lubricant and a method for manufacturing the same.

A sliding sheet includes a fabric layer. The fabric layer includes a plurality of warp yarns and a plurality of weft yarns. The warp yarns are interlaced with the weft yarns. The sliding sheet has a first edge extending in a length direction of the sliding sheet. The warp yarns are bent toward a middle portion of the first edge.

In an embodiment, the sliding sheet has a second edge extending in the length direction of the sliding sheet. The first edge is opposite to the second edge. The weft yarns radially extend from the middle portion of the first edge to the second edge.

In an embodiment, an axis of symmetry is defined in the plane of the fabric layer. The axis of symmetry is substantially perpendicular to the first edge and passes through a center of the first edge. Each warp yarn is symmetric with respect to the axis of symmetry.

In an embodiment, warp yarns have an arch shape.

In an embodiment, a height of the arch is in a range from about 0.3 millimeters (mm) to about 15 mm.

In an embodiment, two ends of at least one warp yarn are located on the first edge.

In an embodiment, the sliding sheet has a length of about 100 mm to about 500 mm and a width of about 5 mm to about 200 mm.

In an embodiment, the fabric layer further includes a plurality of truncated yarns at the second edge, the truncated yarns are a portion of the warp yarns which are truncated by the second edge, the truncated yarns are cut from the warp yarns along the second edge and located within the fabric layer.

In one embodiment, an axis of symmetry is defined in the plane of the fabric layer. The axis of symmetry is substantially perpendicular to the first edge and passes through the center of the first edge. The weft yarns are symmetrically distributed with respect to the axis of symmetry.

In an embodiment, an angle between each of the plurality of weft yarns and the axis of symmetry is in a range from 0 degrees to 30 degrees.

A method for manufacturing the sliding sheet, the method includes:

weaving an auxiliary yarn, a plurality of warp yarns, and a plurality of weft yarns to form a fabric raw layer, the auxiliary yarn being located on one side of the plurality of warp yarns and substantially parallel to the plurality of warp yarns;

adjusting a tension for weaving the auxiliary yarn into the fabric raw layer so that the tension of the auxiliary yarn is greater than the tension of the plurality of warp yarns, thereby bending the plurality of warp yarns in the fabric raw layer toward the auxiliary yarn;

heating the fabric raw layer to fix shapes of the plurality of warp yarns and the plurality of weft yarns in the fabric raw layer; and cutting the fabric raw layer into the fabric layer according to a shape of the sliding sheet, thereby obtaining the sliding sheet.

A method for manufacturing the sliding sheet, the method includes:

weaving an auxiliary yarn, a plurality of warp yarns, and a plurality of weft yarns to form a fabric raw layer, the auxiliary yarn being located on one side of the plurality of warp yarns and substantially parallel to the plurality of warp yarns, the auxiliary yarn has a greater elasticity than the plurality of warp yarns so that the plurality of warp yarns are bent in the fabric raw layer toward the auxiliary yarn;

heating the fabric raw layer to fix shapes of the plurality of warp yarns and the plurality of weft yarns in the fabric raw layer; and cutting the fabric raw layer into the fabric layer according to a shape of the sliding sheet, thereby obtaining the sliding sheet.

A method for manufacturing the sliding sheet, the method includes:

weaving a plurality of warp yarns and a plurality of weft yarns to form a fabric original layer;

heating a localized area of the fabric original layer to bend the plurality of warp yarns toward the localized area, thereby obtaining the fabric raw layer; and cutting the fabric raw layer into the fabric layer according to a shape of the sliding sheet, thereby obtaining the sliding sheet.

In an embodiment, the method further includes adjusting a weaving direction of the plurality of weft yarns so that the weft yarns are radially extended from the middle portion of a third edge of the fabric raw layer.

A sliding sheet includes a first fabric layer and a second fabric layer stacked with each other. The first fabric layer includes a plurality of first warp yarns and a plurality of first weft yarns. The first warp yarns are interlaced with the first weft yarns. The second fabric layer includes a plurality of second warp yarns and a plurality of second weft yarns. The second warp yarns are interlaced with the second weft yarns. The plurality of second warp yarns pass over one or more first weft yarns from a surface of the first fabric layer remote from the second fabric layer, and pass over one or more second weft yarns from a surface of the second fabric layer remote from the first fabric layer. The sliding sheet has a first edge extending in a length direction of the sliding sheet. The first warp yarns are bent toward a middle portion of the first edge, and/or the second warp yarns are bent toward the middle portion of the first edge.

In an embodiment, in the plane of the first fabric layer and the second fabric layer, the sliding sheet has a second edge extending in the length direction of the sliding sheet. The first edge is opposite to the second edge. The first weft yarns radially extend from the middle portion of the first edge to the second edge, and/or the second weft yarns radially extend from the middle portion of the first edge to the second edge.

In an embodiment, an axis of symmetry is defined in the plane of the first fabric layer and the second fabric layer. The axis of symmetry is substantially perpendicular to the first edge and passes through a center of the first edge. Each first warp yarn is symmetric with respect to the axis of symmetry. Each second warp yarn is symmetric with respect to the axis of symmetry.

In an embodiment, the plurality of first warp yarns and/or the plurality of second warp yarns have an arch shape.

In an embodiment, a height of the arch is in a range from about 0.3 mm to about 15 mm.

In an embodiment, two ends of at least one first warp yarn are located on the first edge, and/or two ends of at least one second warp yarn are located on the first edge.

In an embodiment, in the plane of the first fabric layer and the second fabric layer, the sliding sheet has a second edge extending in the length direction of the sliding sheet. The first edge is opposite to the second edge. The first fabric layer and/or the second fabric layer further includes a plurality of truncated yarns at the second edge. The truncated yarns are a portion of the first warp yarns and/or the second warp yarns which are truncated by the second edge. The truncated yarns are cut from the first warp yarns along the second edge and located within the first fabric layer and/or from the second warp yarns along the second edge located within the second fabric layer.

In an embodiment, an axis of symmetry is defined in the plane of the first fabric layer and second fabric layer. The axis of symmetry is substantially perpendicular to the first edge and passes through the center of the first edge. The first weft yarns are symmetrically distributed with respect to the axis of symmetry. The second weft yarns are symmetrically distributed with respect to the axis of symmetry.

In an embodiment, an angle between each of the plurality of first weft yarns and/or second weft yarns and the axis of symmetry is in a range from 0 degrees to 30 degrees.

A method for manufacturing the sliding sheet, the method includes:

weaving a first auxiliary yarn, a plurality of first warp yarns, and a plurality of first weft yarns to form a first fabric raw layer, the first auxiliary yarn being located on one side of the plurality of first warp yarns and substantially parallel to the plurality of first warp yarns;

weaving a second auxiliary yarn, a plurality of second warp yarns, and a plurality of second weft yarns to form a second fabric raw layer, and weaving the first fabric raw layer together with the second fabric raw layer, the second auxiliary yarn being located on one side of the plurality of second warp yarns and substantially parallel to the plurality of second warp yarns;

adjusting a tension for weaving the first auxiliary yarn into the first fabric raw layer so that the tension of the first auxiliary yarn is greater than the tension of the plurality of first warp yarns, thereby bending the plurality of first warp yarns in the first fabric raw layer toward the first auxiliary yarn, and/or adjusting the tension for weaving the second auxiliary yarn into the second fabric raw layer so that the tension of the second auxiliary yarn is greater than the tension of the plurality of second warp yarns, thereby bending the plurality of second warp yarns in the second fabric raw layer toward the second auxiliary yarn;

heating the first fabric raw layer and the second fabric raw layer to fix shapes of the plurality of first warp yarns and the plurality of first weft yarns in the first fabric raw layer and to fix shapes of the plurality of second warp yarns and the plurality of second weft yarns in the second fabric raw layer; and cutting the first fabric raw layer and the second fabric raw layer into the first fabric layer and the second fabric layer according to a shape of the sliding sheet, thereby obtaining the sliding sheet.

In an embodiment, the first auxiliary yarn and the second auxiliary yarn are located at a same side of the first fabric raw layer and the second fabric raw layer.

A method for manufacturing the sliding sheet, the method includes:

weaving an first auxiliary yarn, a plurality of first warp yarns, and a plurality of first weft yarns to form a first fabric raw layer, the first auxiliary yarn being located on one side of the plurality of first warp yarns and substantially parallel to the plurality of first warp yarns;

weaving a second auxiliary yarn, a plurality of second warp yarns, and a plurality of second weft yarns to form a second fabric raw layer, and weaving the first fabric raw layer together with the second fabric raw layer, the second auxiliary yarn being located on one side of the plurality of second warp yarns and substantially parallel to the plurality of second warp yarns;

bending the plurality of first warp yarns in the first fabric raw layer toward the first auxiliary yarn by having an elasticity of the first auxiliary yarn greater than the elasticity of the plurality of first warp yarns, and/or bending the plurality of second warp yarns in the second fabric raw layer toward the second auxiliary yarn by having the elasticity of the second auxiliary yarn greater than the elasticity of the plurality of second warp yarns;

heating the first fabric raw layer and the second fabric raw layer to fix shapes of the plurality of first warp yarns and the plurality of first weft yarns in the first fabric raw layer and to fix shapes of the plurality of second warp yarns and the plurality of second weft yarns in the second fabric raw layer; and cutting the first fabric raw layer and the second fabric raw layer into the first fabric layer and the second fabric layer according to a shape of the sliding sheet, thereby obtaining the sliding sheet.

In an embodiment, the first auxiliary yarn and the second auxiliary yarn are located at a same side of the first fabric raw layer and the second fabric raw layer.

A method for manufacturing the sliding sheet, the method includes:

weaving a plurality of first warp yarns and a plurality of first weft yarns to form a first fabric original layer;

weaving a plurality of second warp yarns and a plurality of second weft yarns to form a second fabric original layer, and weaving the first fabric original layer together with the second fabric original layer;

heating the first fabric original layer to bend the plurality of first warp yarns and the plurality of first weft yarns toward a localized area that is heated, thereby obtaining the first fabric raw layer;

heating a localized area of the second fabric original layer to bend the plurality of second warp yarns and the plurality of second weft yarns toward the localized area that is heated, thereby obtaining the second fabric raw layer; and cutting the first fabric raw layer and the second fabric raw layer into the first fabric layer and the second fabric layer according to a shape of the sliding sheet, thereby obtaining the sliding sheet.

In an embodiment, the method further includes adjusting a weaving direction of the plurality of first weft yarns so that the first weft yarns are radially extended from a middle portion of a third edge, and/or adjusting a weaving direction of the plurality of second weft yarns so that the second weft yarns are radially extended from the middle portion of the third edge.

In the sliding sheet and the method for manufacturing the sliding sheet of the present application, the warps of the fabric layer of the sliding sheet are bent toward the middle portion of the first edge. Thereby, a lubricant infiltrated in the fabric layer tends to flow toward the middle portion of the first edge during a rotation of the endless fixing belt relative to the sliding sheet, avoiding or reducing a leakage from two ends in a length direction of the sliding sheet, allowing the lubricant left on the surface of the endless fixing belt to be capable of being retrieved by the sliding sheet after a round of rotation of the endless fixing belt. Accordingly, the sliding sheet can keep the original amount of the lubricant in a better level during a long-term service life, the service life of the endless fixing belt can be increased, and a cost for maintaining the fixing device and the image forming apparatus can be reduced.

BRIEF DESCRIPTION OF THE DRAWINGS

In order to provide a clearer description of the embodiments of the present application, the following drawings, which are to be used in the description of the embodiments, are briefly described. The drawings only shows a number of embodiments of the present application, and other drawings can be obtained by those skilled in the art without doing an inventive work.

DETAILED DESCRIPTION

The present application will now be described in detail with reference to the accompanying drawings and embodiments in order to make the objects, technical solutions, and advantages of the present application more clear. The embodiments described herein are for the purpose of explaining the application and are not intended to limit the application.

Figure 1:
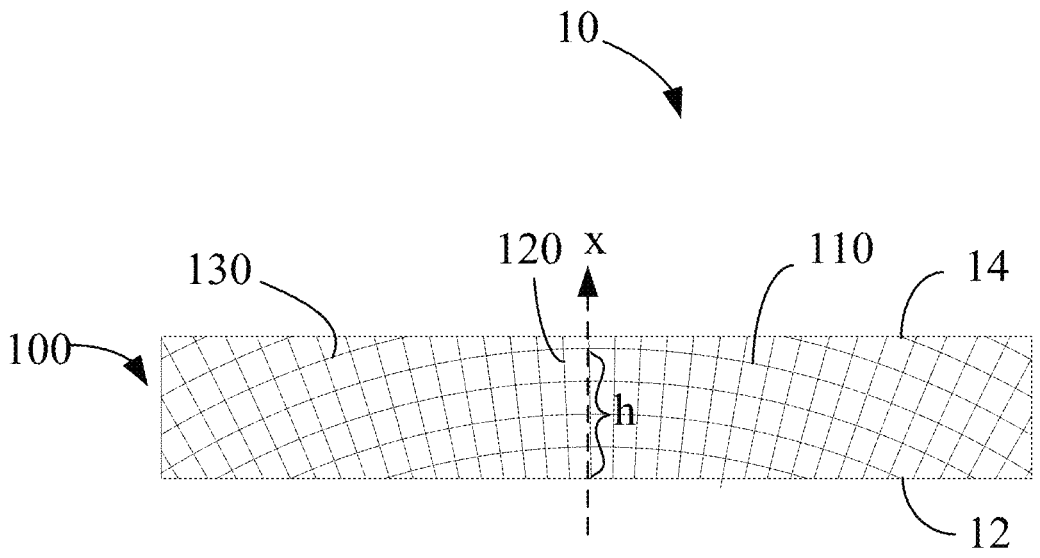
FIG. 1 is a schematic top view of one embodiment of the present application of a sliding sheet.

Referring to FIG. 1, an embodiment of the present application provides a sliding sheet 10 including one or more fabric layers 100. The sliding sheet 10 has a length direction and a width direction. The fabric layer 100 includes a plurality of warp yarns 110 and a plurality of weft yarns 120. The plurality of warp yarns 110 are interlaced with the plurality of weft yarns 120. In the plane of the fabric layer 100, the sliding sheet 10 has a first edge 12, the first edge 12 extends in the length direction of the sliding sheet 10, and the plurality of warp yarns 110 are bent toward a middle portion of the first edge 12. The plurality of warp yarns 110 are substantially parallel to each other. In the plane of the fabric layer 100, the sliding sheet 10 can further have a second edge 14. The second edge 14 extends in the length direction of the sliding sheet 10, and the first edge 12 is opposite to the second edge 14. The first edge 12 and the second edge 14 can also be the edges of the fabric layer 100.

In an embodiment, the plurality of weft yarns 120 can diverge (or radially extend) from the middle portion of the first edge 12 to the second edge 14 such that a distance near the first edge 12 is less than the distance near the second edge 14 between adjacent weft yarns 120. An angle between the weft yarn 120 and the first edge 12 can be gradually changed in different weft yarns 120. The angle between the weft yarn 120 located at the middle portion of the first edge 12 and the first edge 12 can be substantially 90 degrees. The closer the weft yarn 120 to the end of the first edge 12, the smaller the angle between the weft yarn 120 and the first edge 12.

In the present application, the warp yarns 110 refer to the yarns extending substantially along the length direction of the sliding sheet 10, the weft yarns 120 refer to the yarns substantially extending from the first edge 12 to the second edge 14 of the sliding sheet 10. The warp yarns 110 and/or the weft yarns 120 are not limited to be straight or strictly extended in a certain direction. The manner in which the plurality of warp yarns 110 interlace with the plurality of weft yarns 120 can be, but is not limited to, a warp yarn 110 alternatively pass the plurality of weft yarns 120 from the two opposite surfaces of the fabric layer 100, and a weft yarn 120 alternatively pass the plurality of warp yarns 120 from the two opposite surfaces of the fabric layer 100, so as to weave the plurality of warp yarns 110 together with the plurality of weft yarns 120. The warp yarn 110 is bent toward the middle portion of the first edge 12 such that a portion of the warp yarn 110 farthest from the first edge 12 is located at the middle portion of the sliding sheet 10 in the length direction, and a portion of the warp yarn 110 closest to the first edge 12 is located at two ends of the sliding sheet 10 in the length direction.

The sliding sheet 10 can have a length of about 100 mm to about 500 mm and a width of about 5 mm to about 200 mm. The middle portion of the first edge 12 can be a center point of the first edge 12 or a central section taking 1% to 10% of the length of the first edge 12. The two ends of the warp yarn 110 are closer to the first edge 12, and the middle of the warp yarn 110 is farther to the first edge 12. In an embodiment, two ends of at least one warp yarn 110 are located on the first edge 12. The plurality of warp yarns 110 can be arcuate (e.g., have an arch shape). A height of the arch h is defined as a shortest distance from an apex of the arch to a line connecting the two ends of the warp yarn 110. In one embodiment, h is in a range from about 0.3 mm to about 15 mm.

In one embodiment, an axis of symmetry x is defined in the plane of the fabric layer 100. The axis of symmetry x is substantially perpendicular to the first edge 12 and passes through the center of the first edge 12. Each warp yarn 110 can have a symmetrical shape about the axis of symmetry x. The plurality of weft yarns 120 can be symmetrically distributed about the axis of symmetry. An angle between each of the plurality of weft yarns 120 and the axis of symmetry x can be in a range from 0 degrees to 90 degrees, in some embodiments be in a range from 0 degrees to 60 degrees, and in some embodiments be in a range from 0 degrees to 30 degrees. The angle can be gradually getting larger from the center to the two ends of the first edge 120.

The fabric layer 100 can further include a plurality of truncated yarns 130 located at the second edge 14. The truncated yarns 130 are a portion of the warp yarns 110 which are truncated by the second edge 14, the truncated yarns 130 are cut from the warp yarns along the second edge 14 and located within the fabric layer 100.

A material of the warp yarns 110 and the weft yarns 120 withstand a working temperature, for example, equal to or greater than 80° C., and in one embodiment in a range of 160° C. to 260° C. The material of the warp yarns 110 and the weft yarns 120 can be selected from, but not limited to, at least one of polytetrafluoroethylene and polyphenylene sulfide.

A thickness of the sliding sheet 10 can be in a range from 0.2 mm to 1 mm.

Figure 2:
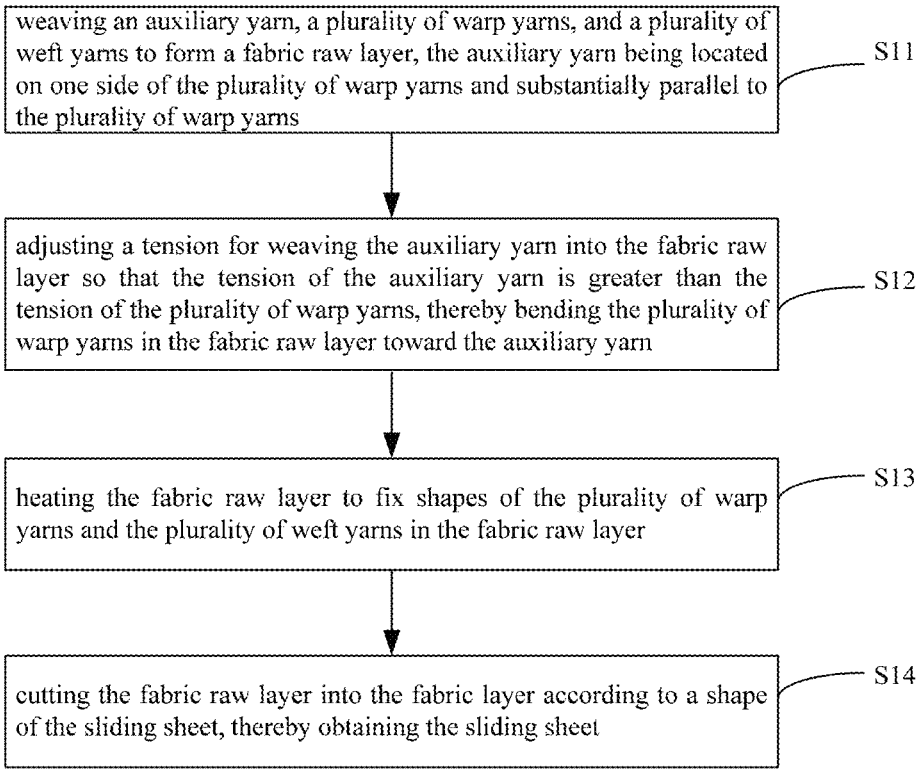
FIG. 2 is a flow chart of an embodiment of the present application of a method for manufacturing the sliding sheet.
Figure 3:
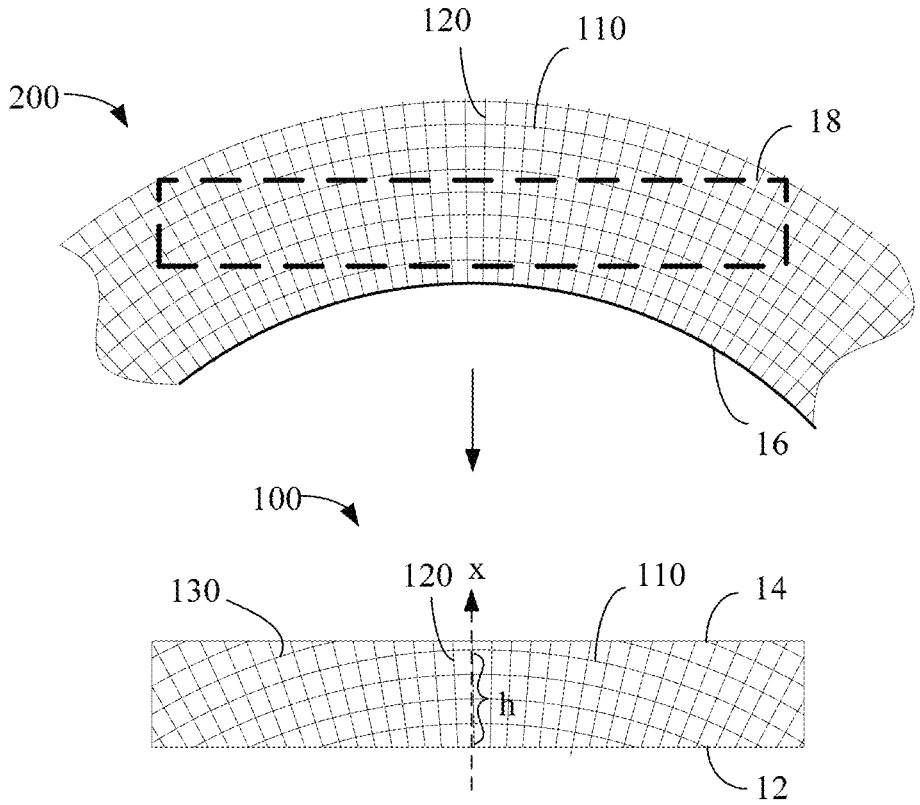
FIG. 3 is a schematic top view of the embodiment of the present application of the method for manufacturing the sliding sheet.

Referring to FIG. 2 and FIG. 3, the present application further provides an embodiment of a method for manufacturing the sliding sheet 10, the method includes:

S11, weaving an auxiliary yarn 16, the plurality of warp yarns 110, and the plurality of weft yarns 120 to form a fabric raw layer 200, the auxiliary yarn 16 being located at one side of the plurality of warp yarns 110 and substantially parallel to the plurality of warp yarns 110;

S12, adjusting a tension for weaving the auxiliary yarn 16 into the fabric raw layer 200 during the weaving of step S11, so that the tension of the auxiliary yarn 16 is greater than the tension of the plurality of warp yarns 110, thereby bending the plurality of warp yarns 110 in the fabric raw layer 200 toward the auxiliary yarn 16;

S13, heating the fabric raw layer 200 to fix the shapes of the plurality of warp yarns 110 and the shapes of the plurality of weft yarns 120 in the fabric raw layer 200; and S14, cutting the fabric raw layer 200 into the fabric layer 100 according to a shape of the sliding sheet 10.

In the weaving of the step S11, all of the warp yarns 110 can have the same material and elasticity. In step S12, the tension of the auxiliary yarn 16 can be increased to produce a tightening effect on the plurality of weft yarns 120, thereby bending the plurality of warp yarns 110 toward the auxiliary yarn 16 so as to result an overall bending effect of the fabric raw layer 200 toward the auxiliary yarn 16. As the warp yarns 110 are bent, the plurality of weft yarns 120 can be simultaneously divergent or radially extended. In step S13, the bent warp yarns 110 and the radially extended weft yarns 120 are fixed in shape by heating the fabric raw layer 200. In step S14, the cutting can remove the auxiliary yarn 16 and form the first edge 12 which is the edge of the fabric layer 110 that near the auxiliary yarn 16.

Figure 4:
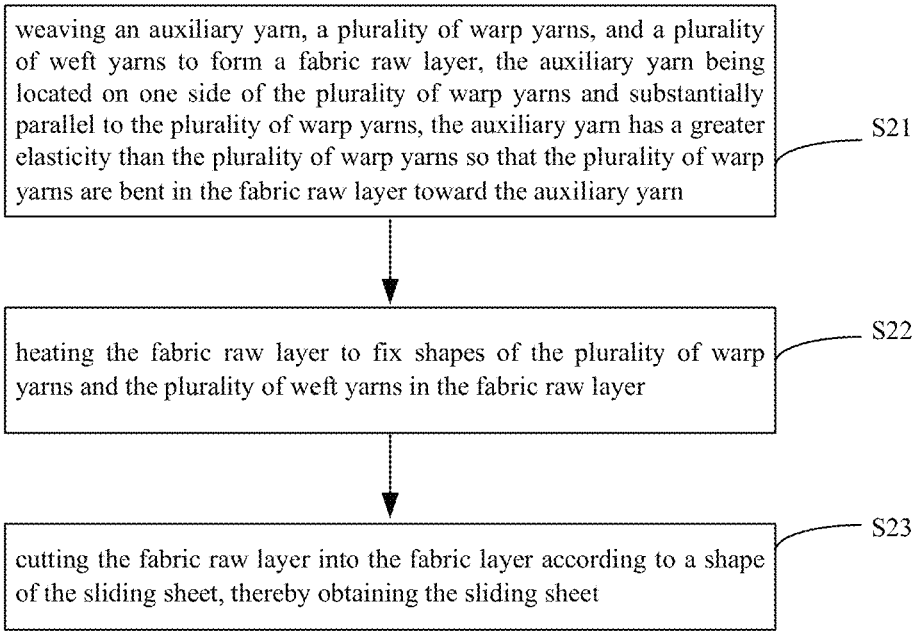
FIG. 4 is a flow chart of another embodiment of the present application of the method for manufacturing the sliding sheet.

Referring to FIG. 4, the present application further provides an embodiment of the method for manufacturing the sliding sheet, and the method includes:

S21, weaving an auxiliary yarn 16, a plurality of warp yarns 110, and a plurality of weft yarns 120 to form a fabric raw layer 200, the auxiliary yarn 16 being located at one side of the plurality of warp yarns 110 and substantially parallel to the plurality of warp yarns 110, the auxiliary yarn 16 has a greater elasticity than the plurality of warp yarns 110 so that the plurality of warp yarns 110 are bent in the fabric raw layer 200 toward the auxiliary yarn 16;

S22, heating the fabric raw layer 200 to fix shapes of the plurality of warp yarns 110 and the plurality of weft yarns 120 in the fabric raw layer 200; and S23, cutting the fabric raw layer 200 into the fabric layer 100 according to a shape of the sliding sheet 10.

In this embodiment, the same pulling force can be used during the weaving of the auxiliary yarn 16 and the warp yarns 110 woven into the fabric raw layer 200, but the auxiliary yarn 16 has a greater elasticity than the warp yarns 110, thereby bending the yarns 110 toward the auxiliary yarn 16, so as to result an overall bending effect of the fabric raw layer 200 toward the auxiliary yarn 16. As the warp yarns 110 are bent, the plurality of weft yarns 120 can be simultaneously divergent or radially extended. In step S22, the bent warp yarns 110 and the radially extended weft yarns 120 are fixed in shape by heating the fabric raw layer 200. In step S23, the cutting can remove the auxiliary yarn 16 and form the first edge 12 which is the edge of the fabric layer 110 that near the auxiliary yarn 16.

Figure 5:
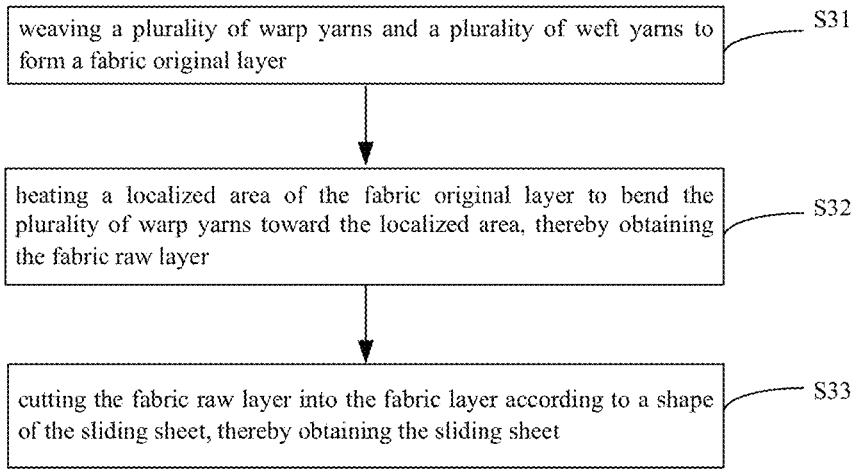
FIG. 5 is a flow chart of yet another embodiment of the present application of the method for manufacturing the sliding sheet.

Referring to FIG. 5, the present application further provides an embodiment of the method for manufacturing the sliding sheet, the method includes:

S31, weaving a plurality of warp yarns 110 and a plurality of weft yarns 120 to form a fabric original layer;

S32, heating a localized area of the fabric original layer to bend the plurality of warp yarns 110 toward the localized area, thereby obtaining the fabric raw layer 200; and S33, cutting the fabric raw layer 200 into the fabric layer 100 according to a shape of the sliding sheet 10.

In this embodiment, without using the auxiliary yarn 16, all of the warp yarns 110 can have the same elasticity and the same tension during weaving into the fabric original layer, so that the warp yarns 110 and a third edge 16 of the fabric original layer obtained in step S31 can be substantially straight rather than curved or arcuate. In step S32, the warp yarns 110 are thermally shrunk by locally heating of the fabric original layer. The closer to the heating center, the greater of the shrinkage of the warp yarns 110, and the greater of the pulling force toward the center. The father from the heating center, the smaller of the shrinkage of the warp yarns 110, and the smaller of the pulling force toward the center. Thereby, the warp yarns 110 are bent toward the localized area that is heated, so as to result a bending effect of the fabric raw layer 200 toward the localized area that is heated. The localized area that is heated can be located at one edge of the fabric original layer that is substantially parallel to the warp yarns 110. The fabric raw layer 200 is bent toward the edge. The heating temperature can be greater than a working temperature of the sliding sheet 10, for example, greater than 80° C. to 260° C. In step S33, the first edge 12 of the fabric layer 110 obtained from the cutting can pass through the localized area that is heated, and the localized area can be located at the middle portion of the first edge 12.

In the manufacturing embodiments of FIG. 2 to FIG. 5, the fabric raw layer 200 can have one edge, and the warp yarns 110 can be bent toward the center of the edge. In steps S13, S23, and S33, the fabric raw layer 200 can be cut into desired shapes of the fabric layer 100, for example, is cut along a straight line so that the fabric layer 100 has a straight first edge 12.

The embodiments of the above-described manufacturing method can further include demarcating a cutting area 18 on the fabric raw layer 200 and cutting along a boundary of the cutting area 18 to obtain the fabric layer 100. The shape of the cutting area 18 corresponds to the shape of the fabric layer 100. The cutting area 18 can be a rectangular area.

Since the plurality of warp yarns 110 are bent toward one side, the plurality of weft yarns 120 can diverge. The above-described embodiments of the manufacturing method can further include adjusting a weaving direction of the plurality of weft yarns 120 so that the weft yarns 120 are radially extended.

Figure 6:
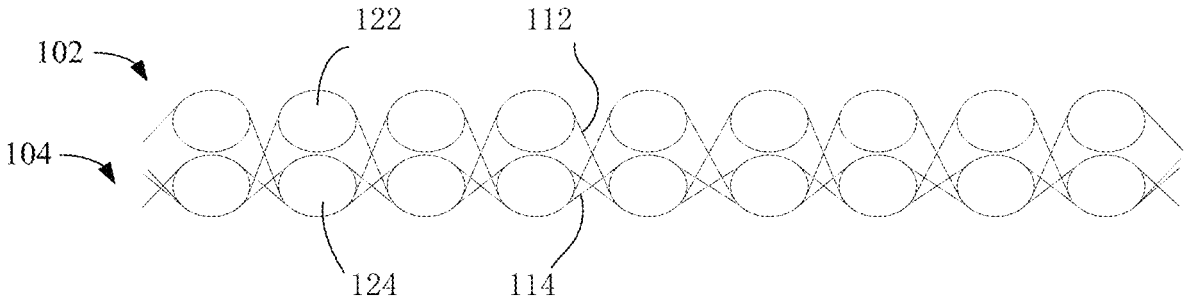
FIG. 6 is a schematic side view of a fabric layer of another embodiment of the present application of the sliding sheet.

Referring to FIG. 1 and FIG. 6, the present application further provides another embodiment of the sliding sheet 10 including a first fabric layer 102 and a second fabric layer 104 stacked with each other, each having the same structure as the fabric layer 100. The first fabric layer 102 includes a plurality of first warp yarns 112 and a plurality of first weft yarns 122, and the plurality of first warp yarns 112 are interlaced with the plurality of first weft yarns 122. The second fabric layer 104 includes a plurality of second warp yarns 114 and a plurality of second weft yarns 124, and the plurality of second warp yarns 114 are interlaced with the plurality of second weft yarns 124. The plurality of second warp yarns 114 pass over one or more first weft yarns 122 from a surface of the first fabric layer 102 remote from the second fabric layer 104, and pass over one or more second weft yarns 124 from a surface of the second fabric layer 104 remote from the first fabric layer 102.

In the plane of the first fabric layer 102 and the second fabric layer 104, the sliding sheet 10 has a first edge 12 extending along the length direction of the sliding sheet 10, and the plurality of first warp yarns 112 are bent toward the middle portion of the first edge 12; and/or the plurality of second warp yarns 114 are bent toward the middle portion of the first edge 12. The plurality of first warp yarns 112 and/or the plurality of second warp yarns 114 can be arcuate (e.g., have an arch shape).

Further, in the plane of the first fabric layer 102 and the second fabric layer 104, the sliding sheet 10 can further have a second edge 14 extending along the length direction of the sliding sheet 10. The first edge 12 is opposite to the second edge 14. The first edge 12 and the second edge 14 can also be the edges of the first fabric layer 102 and the second fabric layer 104. The plurality of first weft yarns 122 can diverge (or radially extend) from the middle portion of the first edge 12 to the second edge 14 and/or the plurality of second weft yarns 124 can diverge (or radially extend) from the middle portion of the first edge 12 to the second edge 14.

In an embodiment, an axis of symmetry x is defined in the plane of the first fabric layer 102 and the second fabric layer 104. The axis of symmetry x is substantially perpendicular to the first edge 12 and passes through the center of the first edge 12. Each first warp yarn 122 can have a symmetrical shape about the axis of symmetry x. Each second warp yarn 124 can have a symmetrical shape about the axis of symmetry x. The plurality of first weft yarns 122 can be symmetrically distributed about the axis of symmetry x. The plurality of second weft yarns 124 can be symmetrically distributed about the axis of symmetry x. An angle between each of the plurality of first weft yarns 122 and/or the plurality of second weft yarns 124 and the axis of symmetry x can be in a range from 0 degrees to 30 degrees.

In an embodiment, the first fabric layer 102 and/or the second fabric layer 104 further includes a plurality of truncated yarns 130 at the second edge 14. The truncated yarns 130 are a portion of the first warp yarns 112 and/or the second warp yarns 114 which are truncated by the second edge 14, the truncated yarns 130 are cut from the first and/or second warp yarns 112, 114 along the second edge 14 and located within the first and/or second fabric layers 102, 104.

The present application further provides an embodiment of the method for manufacturing the sliding sheet 10, the method includes:

S41, weaving a first auxiliary yarn, a plurality of first warp yarns 112, and a plurality of first weft yarns 122 to form a first fabric raw layer, the first auxiliary yarn being located on one side of the plurality of first warp yarns 112 and substantially parallel to the plurality of first warp yarns 112;

S42, weaving a second auxiliary yarn, a plurality of second warp yarns 114, and a plurality of second weft yarns 124 to form a second fabric raw layer, and weaving the first fabric raw layer together with the second fabric raw layer, the second auxiliary yarn being located on one side of the plurality of second warp yarns 114 and substantially parallel to the plurality of second warp yarns 114;

S43, in the process of the step S41 and/or the step S42, adjusting a tension for weaving the first auxiliary yarn into the first fabric raw layer so that the tension of the first auxiliary yarn is greater than the tension of the plurality of first warp yarns 112, thereby bending the plurality of first warp yarns 112 in the first fabric raw layer toward the first auxiliary yarn, and/or adjusting the tension for weaving the second auxiliary yarn into the second fabric raw layer so that the tension of the second auxiliary yarn is greater than the tension of the plurality of second warp yarns 114, thereby bending the plurality of second warp yarns 114 in the second fabric raw layer toward the second auxiliary yarn;

S44, heating the first fabric raw layer and the second fabric raw layer to fix shapes of the plurality of first warp yarns 112 and the plurality of first weft yarns 122 in the first fabric raw layer and to fix shapes of the plurality of second warp yarns 114 and the plurality of second weft yarns 124 in the second fabric raw layer; and S45, cutting the first fabric raw layer and the second fabric raw layer into the first fabric layer 102 and the second fabric layer 104 according to a shape of the sliding sheet 10.

The present application further provides another embodiment of the method for manufacturing the sliding sheet 10, the method includes:

S51, weaving a first auxiliary yarn, a plurality of first warp yarns 112, and a plurality of first weft yarns 122 to form a first fabric raw layer, the first auxiliary yarn being located on one side of the plurality of first warp yarns 112 and substantially parallel to the plurality of first warp yarns 112, an elasticity of the first auxiliary yarn being greater than the elasticity of the plurality of first warp yarns 112;

S52, weaving a second auxiliary yarn, a plurality of second warp yarns 114, and a plurality of second weft yarns 124 to form a second fabric raw layer, and weaving the first fabric raw layer together with the second fabric raw layer, the second auxiliary yarn being located on one side of the plurality of second warp yarns 114 and substantially parallel to the plurality of second warp yarns 114, an elasticity of the second auxiliary yarn being greater than the elasticity of the plurality of second warp yarns 114;

S53, heating the first fabric raw layer and the second fabric raw layer to fix shapes of the plurality of first warp yarns 112 and the plurality of first weft yarns 122 in the first fabric raw layer and to fix shapes of the plurality of second warp yarns 114 and the plurality of second weft yarns 124 in the second fabric raw layer; and S54, cutting the first fabric raw layer and the second fabric raw layer into the first fabric layer 102 and the second fabric layer 104 according to a shape of the sliding sheet.

The present application further provides yet another embodiment of the method for manufacturing the sliding sheet 10, the method includes:

S61, weaving a plurality of first warp yarns 112 and a plurality of first weft yarns 122 to form a first fabric original layer;

S62, weaving a plurality of second warp yarns 114 and a plurality of second weft yarns 124 to form a second fabric original layer, and weaving the first fabric original layer together with the second fabric original layer;

S63, heating the first fabric original layer to bend the plurality of first warp yarns 112 and the plurality of first weft yarns 122 toward a localized area that is heated, thereby obtaining the first fabric raw layer, and/or heating a localized area of the second fabric original layer to bend the plurality of second warp yarns 114 and the plurality of second weft yarns 124 toward the localized area that is heated, thereby obtaining the second fabric raw layer; and S64, cutting the first fabric raw layer and the second fabric raw layer into the first fabric layer 102 and the second fabric layer 104 according to a shape of the sliding sheet 10.

Figure 7:
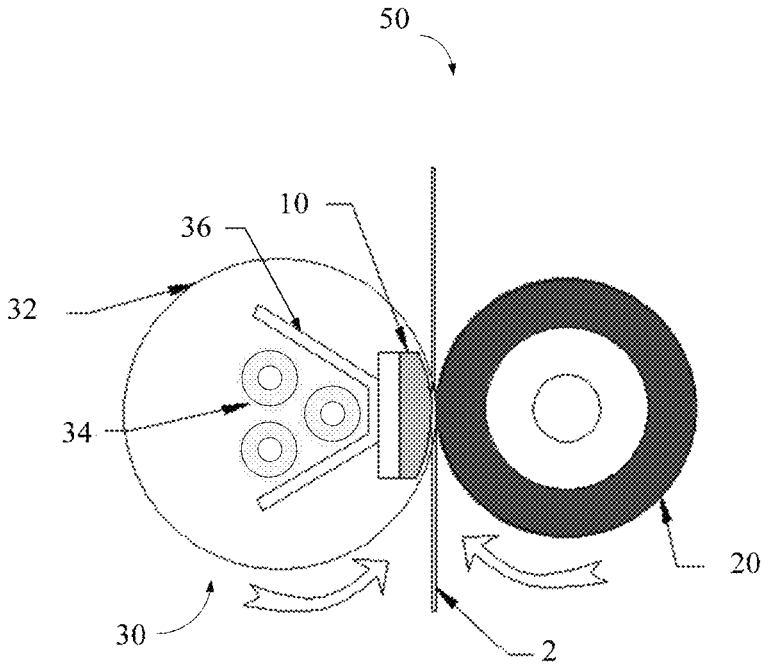
FIG. 7 is a schematic side view of an embodiment of the present application of a fixing device.

Referring to FIG. 7, the present application further provides an embodiment of a fixing device 50 including the sliding sheet 10. The fixing device 50 can further include a pressure roller 20 as a driving roller and a heating roller 30 as a driven roller. The heating roller 30 includes an endless fixing belt 32, a heat source 34 and a supporting member 36 disposed inside a loop formed by the endless fixing belt 32. The heat source 34 is configured for heating the endless fixing belt 32. The support member 36 is configured for supporting the sliding sheet 10. The sliding sheet 10 is provided between the support member 36 and the endless fixing belt 32. The sliding sheet 10 is provided on a side of a portion of the endless fixing belt 32 that is closest to the pressure roller 20. The sliding sheet 10 is capable of supporting the endless fixing belt 32 so that a pressing force can be applied between the pressure roller 20 and the endless fixing belt 32.

A recording medium 1 (for example, paper) carries an unfixed image formed by a toner (for example, carbon particles) is conveyed to the pressure roller 20 and the heating roller 30 of the fixing device. The pressure roller 20 rotates and drives the endless fixing belt 32 of the heating roller 30 to rotate therewith such that the recording medium 1 passes between the pressure roller 20 and the endless fixing belt 32 of the heating roller 30, heated and pressed, thereby having the toner fixed on the surface of the recording medium 1. The endless fixing belt 32 moves relative to the supporting member 36 and the sliding sheet 10 which are stationary. A lubricant is provided on the surface of the sliding sheet 10 to reduce a friction resistance between the supporting member 36 and the endless fixing belt 32, thereby alleviating a frictional loss caused by a long-term use of the endless fixing belt 32 and preventing the endless fixing belt 32 from breaking.

Figure 8:
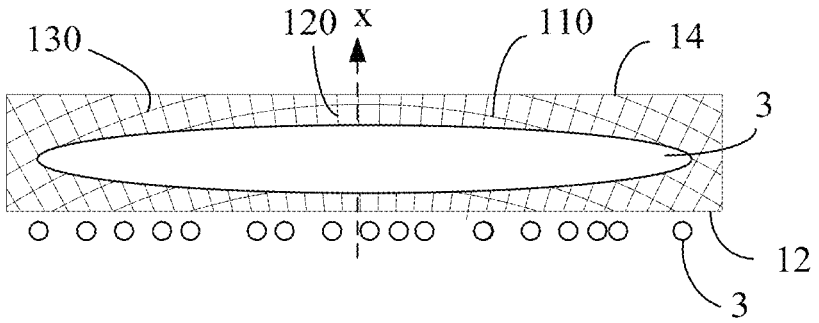
FIG. 8 is a schematic view of an embodiment of the present application of a distribution of a lubricant in a relative movement between the sliding sheet and the endless fixing belt.

Referring to FIG. 8, the length direction of the sliding sheet 10 is perpendicular to the rotating direction of the endless fixing belt 32, and the endless fixing belt 32 rotates from the second edge 14 to the first edge 12. During the relative movement between the sliding sheet 10 and the endless fixing belt 32, the lubricant 3 flows out from the first edge 12 and is coated on the inner surface of the endless fixing belt 32. By bending the warp yarns 110 of the sliding sheet 10 toward the middle portion of the first edge 12, the lubricant 3 infiltrated in the fabric layer tends to be guided by the warp yarns 110 to be aggregated toward the middle portion of the first edge 12 during the rotation of the endless fixing belt 32 relative to the sliding sheet 10. Thereby, a leakage of the lubricant 3 from two ends in the length direction of the sliding sheet 10 can be avoided. The lubricant 3 coated on the inner surface of the endless fixing belt 32 is capable of being retrieved by the second edge 14 of the sliding sheet 10 after a round of the rotation of the endless fixing belt 32. Accordingly, the sliding sheet 10 can keep the original amount of lubricant 3 in a better level in a long service life, the service life of the endless fixing belt 32 can be increased. The plurality of weft yarns 120 diverging from the middle portion of the first edge 12 to the second edge 14 also contribute to the aggregation of the lubricant 3 toward the middle portion of the first edge 12.

Figure 9:
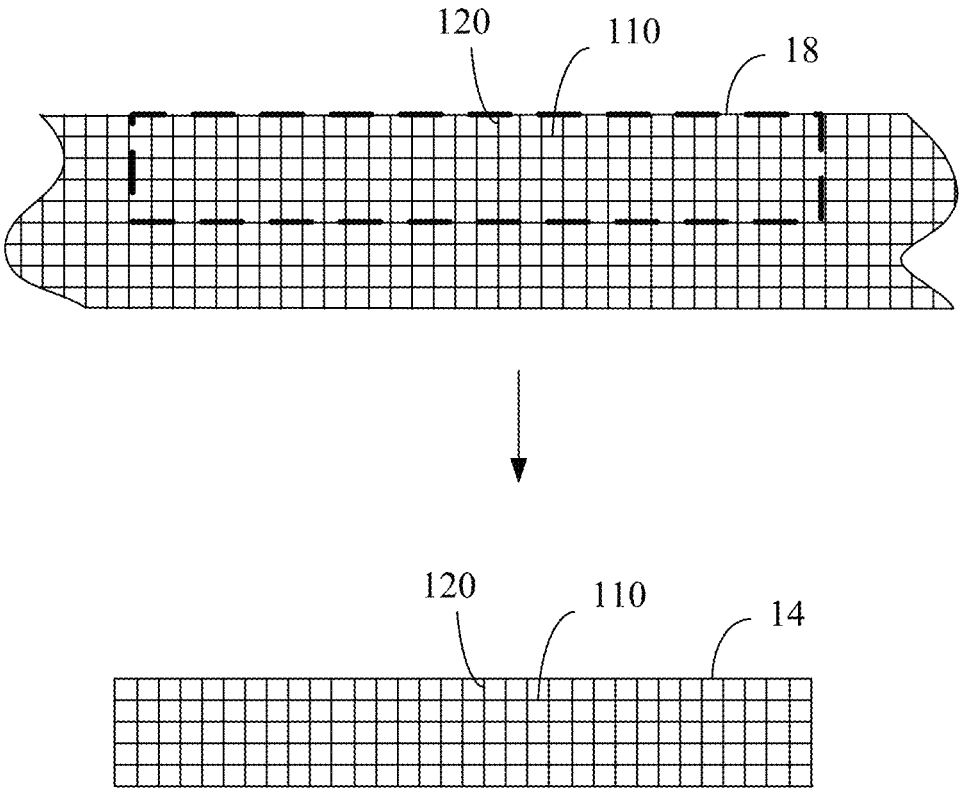
FIG. 9 (Related Art)
FIG. 9 is a schematic top view of a method for manufacturing a sliding sheet in related art.
Figure 10:
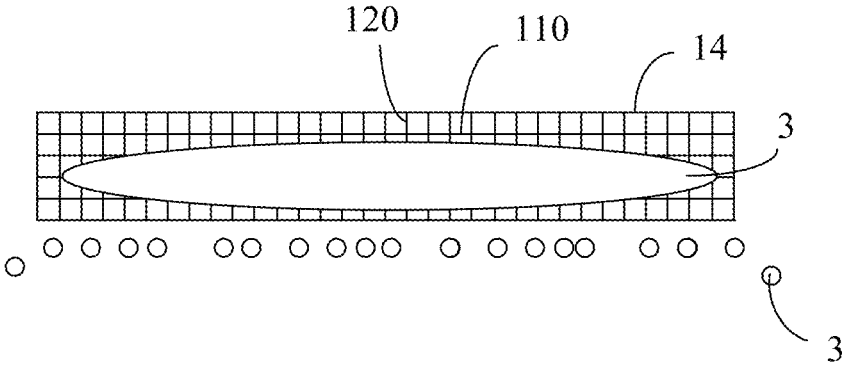
FIG. 10 (Related Art)
FIG. 10 is a schematic view of a distribution of a lubricant in a relative movement between a sliding sheet and an endless fixing belt in related art.

Referring to FIG. 9 and FIG. 10, in a conventional sliding sheet 10, since the warp yarns 110 are straight and substantially perpendicular to the weft yarns 120, during the relative movement between the sliding sheet 10 and the endless fixing belt 32, the lubricant 3 does not have directivity when flowing out from the first edge 12 and easily leaks from both ends of the sliding sheet 10 in the length direction due to the diffusibility of the liquid. When the endless fixing belt 32 rotates a round relative to the sliding sheet 10, the lubricant 3 that are leaked from the ends is hard to be recovered by the second edge 14 of the sliding sheet 10. A problem of gradually losing of the lubricant 3 from the sliding sheet 10 exists in a long-term use.

Figure 11:
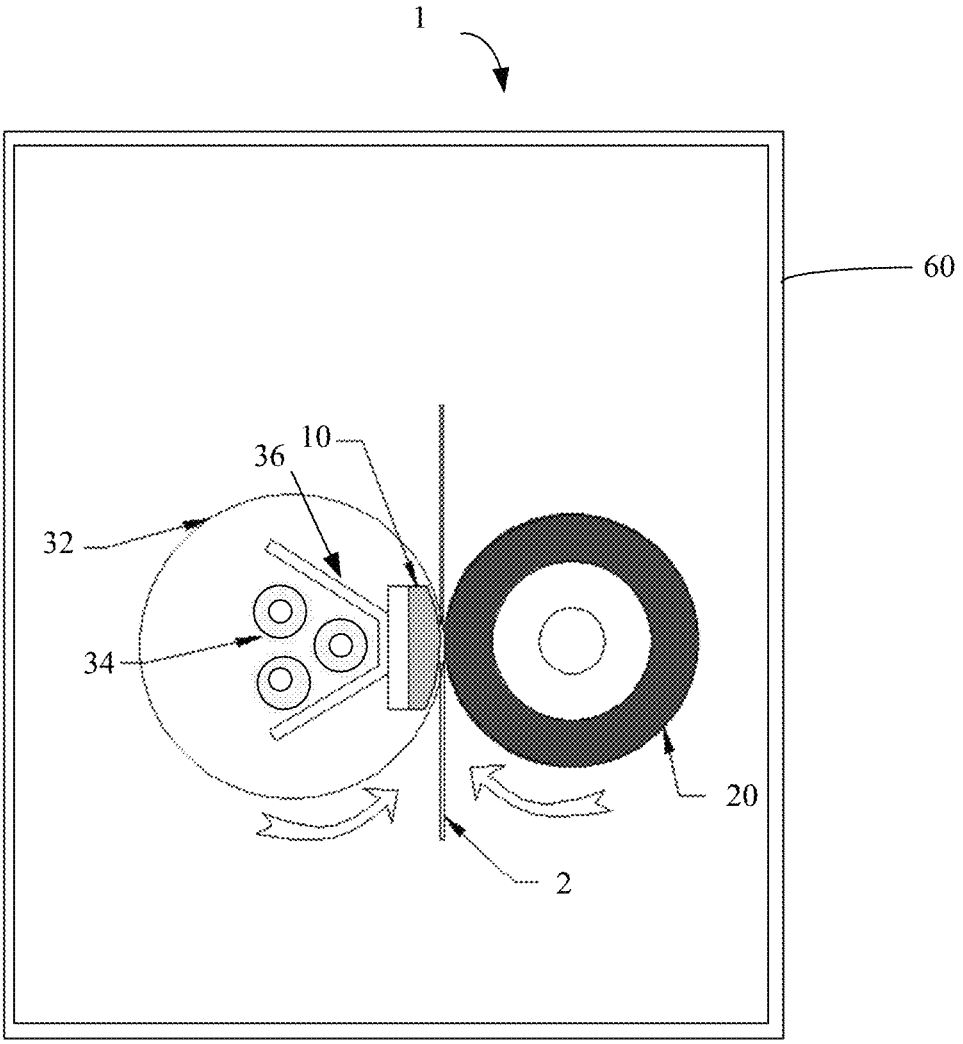
FIG. 11 is a schematic side view of an embodiment of the present application of an image forming apparatus.

Referring to FIG. 11, the present application further provides an embodiment of an image forming apparatus 1 including a fixing device 50. In an embodiment, the image forming apparatus is a printer, a copier, or a facsimile.

Finally, it is to be understood that the above-described embodiments are intended to illustrate rather than limit the present disclosure. Variations may be made to the embodiments without departing from the spirit of the present disclosure as claimed. Elements associated with any of the above embodiments are envisioned to be associated with any other embodiments. The above-described embodiments illustrate the scope of the present disclosure but do not restrict the scope of the present disclosure.

What is claimed is:

1. A sliding sheet comprising a fabric layer, the fabric layer comprising a plurality of warp yarns and a plurality of weft yarns, the plurality of warp yarns being interlaced with the plurality of weft yarns, the sliding sheet having a first edge extending in a length direction of the sliding sheet, and the warp yarns being bent toward a middle portion of the first edge, two ends of at least one of the plurality of warp yarns are located on the first edge, wherein the sliding sheet is included as a part of a fixing device which further includes a presser roller and a heating roller.

2. The sliding sheet of claim 1 having a second edge extending in the length direction of the sliding sheet, wherein the first edge is opposite to the second edge, the plurality of weft yarns radially extend from the middle portion of the first edge to the second edge.

3. The sliding sheet of claim 1, wherein the plurality of warp yarns are in shape of arch, and the arch has a height in a range from about 0.3 mm to about 15 mm.

4. The sliding sheet of claim 1 having a length of about 100 mm to about 500 mm and a width of about 5 mm to about 200 mm.

5. The sliding sheet of claim 1, wherein an axis of symmetry is defined in the fabric layer, the axis of symmetry is substantially perpendicular to the first edge and passes through a center of the first edge, and each warp yarn is symmetric with respect to the axis of symmetry.

6. The sliding sheet of claim 5, wherein the plurality of weft yarns are symmetrically distributed with respect to the axis of symmetry.

7. The sliding sheet of claim 5, wherein an angle between the plurality of weft yarns and the axis of symmetry is in a range from 0 degrees to 30 degrees.

8. A sliding sheet comprising:

a first fabric layer comprising a plurality of first warp yarns and a plurality of first weft yarns, the first warp yarns being interlaced with the first weft yarns; and a second fabric layer stacked with the first fabric layer, the second fabric layer comprising a plurality of second warp yarns and a plurality of second weft yarns, the second warp yarns being interlaced with the second weft yarns;

wherein the plurality of second warp yarns pass over one or more first weft yarns from a surface of the first fabric layer remote from the second fabric layer, and pass over one or more second weft yarns from a surface of the second fabric layer remote from the first fabric layer;

the sliding sheet has a first edge extending in a length direction of the sliding sheet;

the first warp yarns are bent toward a middle portion of the first edge, and/or the second warp yarns are bent toward the middle portion of the first edge, wherein the sliding sheet is included as a part of a fixing device which further includes a presser roller and a heating roller.

9. The sliding sheet of claim 8 having a second edge extending in the length direction of the sliding sheet, the first edge is opposite to the second edge, wherein the first weft yarns radially extend from the middle portion of the first edge to the second edge, and/or the second weft yarns radially extend from the middle portion of the first edge to the second edge.

10. The sliding sheet of claim 1, wherein two ends of each of the plurality of warp yarns being closer to the first edge, and a middle of the each of the plurality of warp yarns being farther to the first edge.

11. The sliding sheet of claim 8, wherein two ends of each of the plurality of first warp yarns being closer to the first edge, and a middle of the each of the plurality of first warp yarns being farther to the first edge; and two ends of each of the plurality of second warp yarns being closer to the first edge, and a middle of the each of the plurality of second warp yarns being farther to the first edge.

* * * * *